United States Patent [19]

Bjurling

[11] 4,416,384

[45] Nov. 22, 1983

[54] TANK CONTAINER WITH MOUNTING MEANS

[75] Inventor: Anders Bjurling, Skultuna, Sweden

[73] Assignee: Dynatrans AB, Hisings Backa, Sweden

[21] Appl. No.: 320,955

[22] PCT Filed: Mar. 9, 1981

[86] PCT No.: PCT/SE81/00073

§ 371 Date: Nov. 6, 1981

§ 102(e) Date: Nov. 6, 1981

[87] PCT Pub. No.: WO81/02561

PCT Pub. Date: Sep. 17, 1981

[30] Foreign Application Priority Data

Mar. 7, 1980 [SE] Sweden ..... 8001797

[51] Int. Cl.[3] ..... B65D 88/06

[52] U.S. Cl. ..... 220/1.5; 220/18.1; 220/70.1; 220/71; 220/72.1

[58] Field of Search ..... 220/1 B, 1.5, 71, 401, 220/18.1, 70.1, 72.1

[56] References Cited

U.S. PATENT DOCUMENTS

| | | | |
|---|---|---|---|
| 2,477,831 | 8/1949 | Schmitz, Jr. | 220/1 |
| 2,592,974 | 4/1952 | Sulfrian | 220/15 |
| 3,726,431 | 4/1973 | Botkin | 220/12 |
| 4,060,174 | 11/1977 | Gerhard | 220/1.5 X |

FOREIGN PATENT DOCUMENTS

| | | | |
|---|---|---|---|
| 1164068 | 2/1964 | Fed. Rep. of Germany | 200/1 B |
| 1912925 | 9/1970 | Fed. Rep. of Germany . | |
| 2646263 | 4/1977 | Fed. Rep. of Germany . | |
| 1535681 | 8/1968 | France | 220/1 B |
| 1577510 | 8/1969 | France | 220/1 B |
| 348702 | 9/1972 | Sweden . | |
| 412053 | 2/1980 | Sweden . | |
| 413236 | 5/1980 | Sweden . | |
| 1362461 | 8/1974 | United Kingdom . | |

*Primary Examiner*—William Price
*Assistant Examiner*—Gary E. Elkins
*Attorney, Agent, or Firm*—Laurence R. Brown

[57] ABSTRACT

A tank container comprising a framework (1–4) and a tank (7) disposed therein.

The tank (7) is secured in the framework (1–4) by means of members (8, 11) transmitting tensile forces in the axial and radial directions of the tank wall so that no bending moment is exerted on the tank wall. These members are preferably radial suspension plates (8) between the ends of the tank and the corners of the end frames and axial fastening plates (11) between the cylindrical portion of the tank and the corners of the end frames.

3 Claims, 7 Drawing Figures

TANK CONTAINER WITH MOUNTING MEANS

TECHNICAL FIELD

The present invention relates to a tank container comprising a framework and a tank disposed therein.

BACKGROUND ART

The tank in such a container must somehow be secured in the framework so that all the forces which occur can be transmitted, and it should be noted that these forces may be considerable with rough handling of a full container.

The most common type of securing is based on saddles or the like in the framework, in which the tank rests or is fixed. These saddles may be supplemented by rods or the like for transmission of axial forces.

Another solution to the securing problem is shown in Swedish Patent No. 326 664, where the cantilevered tank is fixed by means of cylindrical extensions of the tank shell secured in the end frames.

All the known securing devices suffer from various disadvantages, of which high consumption of material, great weight and high price may be mentioned. A fundamental disadvantage is that the securing members (for example saddles) transmit forces to the tank obiquely or at right angles to the tank wall, which is exposed to a greater or lesser bending moment as a result and therefore has to be dimensioned accordingly with consequent high weight and costs.

THE INVENTION

The said disadvantages are according to the invention overcome in that members for transmitting forces in their longitudinal direction are disposed between the framework and the tank in the axial and radial direction of the tank wall, so that the forces between the tank and the framework are transmitted substantially without any bending moment on the tank wall.

These members may be directed in various ways, but in view of the fact that all the forces acting on the tank are axial and radial or can be divided up into such components, it is advisable to provide separate members for axial and radial forces respectively.

In a preferred embodiment this is brought about in such a manner that suspension plates extend radially from the respective end of the tank to the end frames of the framework for the transmission of radial forces and that fastening plates extend axially from the cylindrical portion of the tank to the respective end frame for the transmission of axial forces.

These suspension plates for the radial forces are pliable in the axial direction and therefore cannot transmit axial forces and thus cannot cause harmful bending moments in their securing means in the tank. The same reasoning applies to the axial fastening plates.

Before the tank is mounted in the framework, the tank attachment (with cams for cooperation with the fastening plates) and the suspension plates are welded firmly so that stress-relieving or the like can be carried out without the framework and that the assembly welding can take place without the heat treatment being endangered.

The number of suspension plates or fastening plates at each end of the tank is preferably four, and these plates extend between the tank and the end frame at the four corners.

BRIEF DESCRIPTION OF THE DRAWINGS

The invention will be described in more detail below with reference to the accompanying drawings, in which.

DESCRIPTION OF A PREFERRED EMBODIMENT

Figure 1:
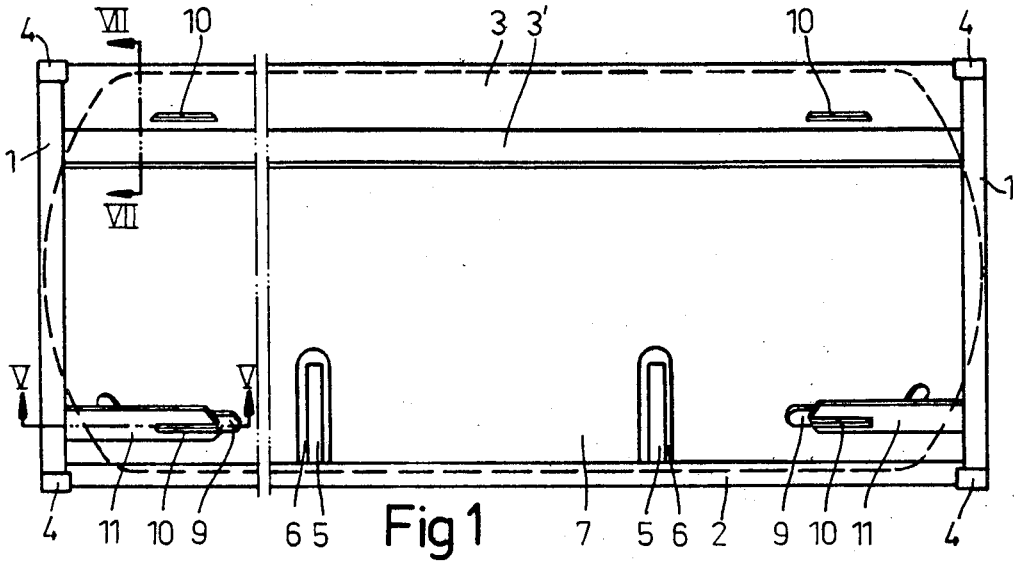
FIGS. 1 and 2 are side views of a tank container according to the invention with and without framework respectively.

A welded-together framework for a tank container consists, in a manner well known to the man skilled in the art, of two end frames 1 (in this case with a somewhat different shape than usual), a bottom frame 2 comprising for example two profiles between the end frames 1, and a sun screen 3 with a design described in more detail below.

This framework preferably has the external dimensions standardized for a container and is provided with corner boxes 4 in its corners in conventional manner.

The bottom frame 2 may be provided with saddles 5 cooperating with corresponding supports 6 fixed to a tank 7, in this case a liquefied petroleum gas tank. It should be observed, however, that these saddles and supports, although they are prescribed for this type of container, only have a secondary purpose in supporting the tank 7 in the framework 1–4. Only with faulty placing or overloading of the tank container consisting of framework and tank does the tank come to be supported to an appreciable extent by the saddles and supports and scarcely during normal use and handling.

The sun screen 3, which is preferably bent along the tank 7 and which may be provided with stiffening boxes 3, one at each long side (corresponding to the bottom frame 2), has a protective purpose but also serves to stiffen the construction further and has the effect of taking up forces.

For the sake of clarity, the tank 7 is shown completely plain but may be composed of separate plates in conventional manner and is provided with the usual fittings, manholes, safety valves etc.

Figure 2:
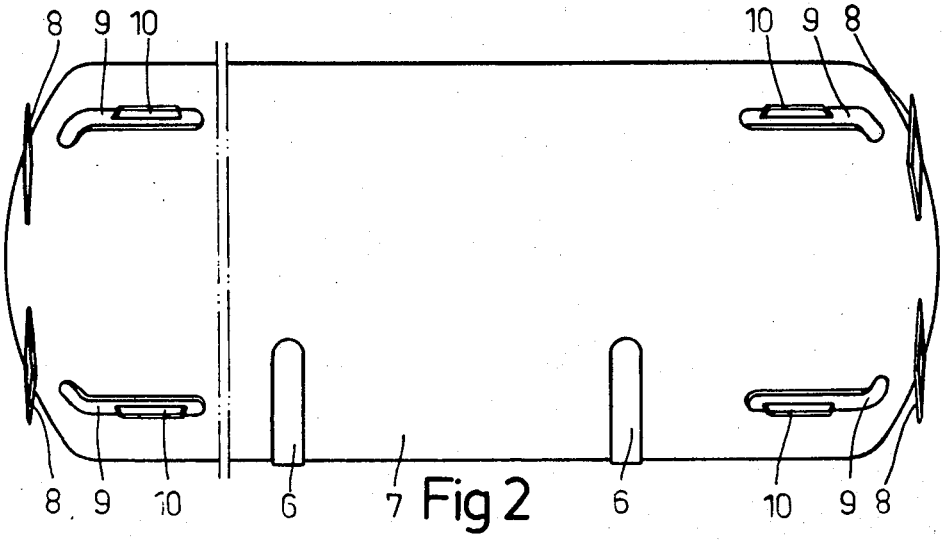
Figure 4:
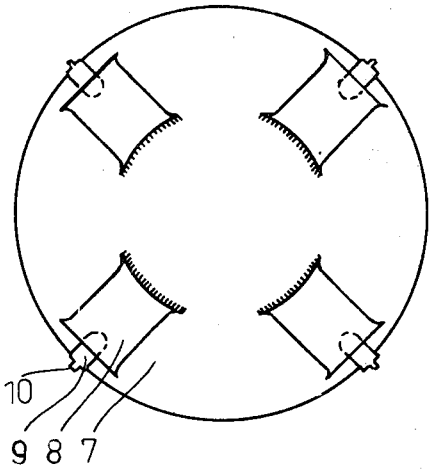
Figure 7:
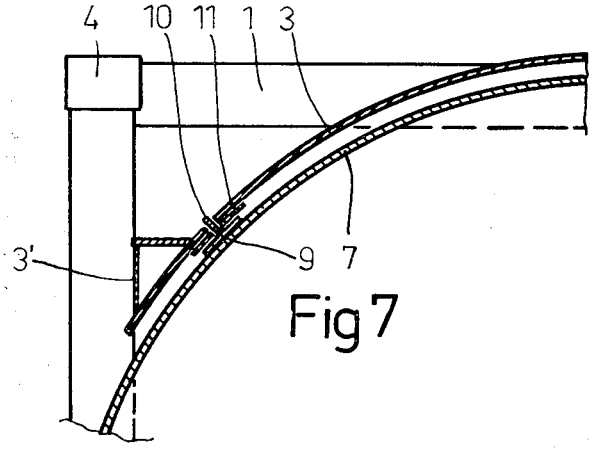
FIG. 7 is a partial section along the line VII—VII in FIG. 1, FIGS. 5–7 being on a larger scale than FIGS. 1–4.

At each end the tank 7 has four welded suspension plates 8 as is most evident in FIGS. 2 and 4. The tank 7 also has eight welded, preferably axial tank attachments 9 with cams 10. After the welding of the parts 8–10, the tank 7 is heat treated (stress-relieved), examined by radiography and pressure tested in the condition shown in FIGS. 2 and 4.

Figure 5:
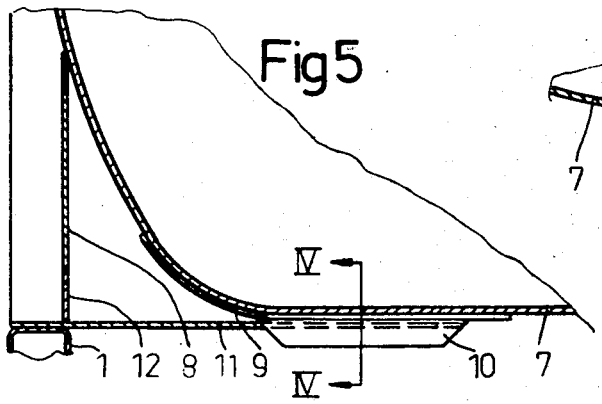
FIG. 5 is a section along the line V—V in FIG. 1.
Figure 6:
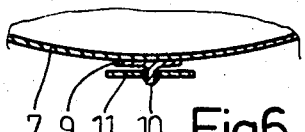
FIG. 6 is a section along line VI—VI in FIG. 5.

The framework 1–4 is provided with eight fastening plates 11, one for each tank attachment 9. These fastening plates are welded to the end frames 1 at their reinforced corners and extend inwards therefrom as can be seen from FIG. 1 and even more clearly from FIG. 5. Each fastening plate 11 is provided with a slot for the corresponding cam 10 of the tank attachment 9. After mounting, when the cam lies in the slot in the fastening plate, the cam is welded to the fastening plate.

Figure 3:
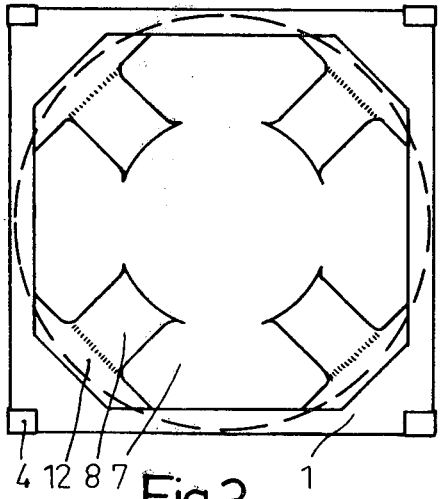
FIGS. 3 and 4 are end views of the same tank container with and without framework respectively.

After mounting, each suspension plate 8 on the tank 7 is likewise welded to a corresponding supporting plate 12 (FIGS. 3 and 5) in the end frame 1.

Since these welding operations do not take place on the tank 7 itself but on parts projecting therefrom, no additional stress-relieving or the like is needed after the introduction of the tank into the framework.

The suspension plates 8 and the fastening plates 11 are comparatively thin, which means that they can transmit large forces in their respective longitudinal direction but not at angles thereto. Thus the fastening plates 11 can substantially only transmit axial forces between the tank 7 and the end frames 1, that is to say forces in the direction of the cylindrical wall; no bending moment is transmitted to the tank. The suspension plates 8, for their part, are pliable in the axial direction but can transmit radial forces at the ends of the tank to the end frames without transmitting bending moments to the tank.

Many modifications are possible within the scope of the claims below. Although the shown arrangement with division into radial and axial force-transmission is preferred, force-transmitting members are also conceivable which extend, near the ends of the tank, in the direction of the tank wall (in the securing points) to the framework. It is likewise possible to alter the number of force-transmitting members and their respective design. The sun screen may also be replaced by more traditional longitudinal profiles, if the protective function is not important.

I claim:

1. A metal tank container comprising a framework surrounding a substantially cylindrical tank with curved surface ends disposed therein, characterized in that a plurality of longitudinally disposed axial suspension plate members are affixed to the tank with one set mounted on the cylindrical tank surface with a mount pliable in the radial direction to bear thereupon for transmitting forces substantially only in their longitudinal direction and another set mounted on the tank ends with a mount pliable in the longitudinal direction to bear thereupon for transmitting forces substantially only in their radial direction and which suspension plate member sets are disposed between the framework and the tank at opposite ends thereof with the respective axial and radial members bearing on the tank walls substantially only in the respective axial and radial directions of the tank wall, and thereby mounted so that the forces between the tank and the framework are transmitted substantially without bending moments on the curved surfaces of the tank wall.

2. A tank container according to claim 1, characterized in that the tank is provided with tank attachments with cams mounted on the axially extending plate members and the framework is provided with axially extending fastening plates 11 with slots therein receiving the cams and welded to the plate members and that the tank attachments and the radially extending suspension plates are welded to the tank before mounting the tank in the framework.

3. A tank container according to claim 2, characterized in that four suspension plates and fastening plates respectively are positioned at each end of the tank and that these plates extend between the tank and the framework at four corners.

* * * * *